US011117250B2

(12) United States Patent
Pallmer et al.

(10) Patent No.: US 11,117,250 B2
(45) Date of Patent: Sep. 14, 2021

(54) HAND-HELD MACHINE TOOL

(71) Applicant: Hilti Aktiengesellschaft, Schaan (LI)

(72) Inventors: Pierre Pallmer, Igling (DE); Steffen Geiger, Munich (DE); Ferdinand Kristen, Gilching (DE); Franz Popp, Buchloe (DE); Erich Daigeler, Waal (DE); Henrik Luessmann, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 33 days.

(21) Appl. No.: 16/311,570

(22) PCT Filed: Jun. 20, 2017

(86) PCT No.: PCT/EP2017/065060
§ 371 (c)(1),
(2) Date: Dec. 19, 2018

(87) PCT Pub. No.: WO2017/220561
PCT Pub. Date: Dec. 28, 2017

(65) Prior Publication Data

US 2019/0184538 A1 Jun. 20, 2019

(30) Foreign Application Priority Data

Jun. 24, 2016 (EP) ..... 16176080

(51) Int. Cl.
*B25D 11/12* (2006.01)
*B25D 17/06* (2006.01)

(52) U.S. Cl.
CPC ..... *B25D 11/125* (2013.01); *B25D 17/06* (2013.01); *B25D 2217/0023* (2013.01);
(Continued)

(58) Field of Classification Search
CPC ..... B25D 2217/0023; B25D 11/125; B25D 17/06; B25D 2222/27; B25D 2222/54; B25D 2250/345
(Continued)

(56) References Cited

U.S. PATENT DOCUMENTS 3,114,421 A * 12/1963 McCloud ..... B25D 16/00 173/14
4,602,689 A * 7/1986 Wanner ..... B25D 11/125 173/127
(Continued)

FOREIGN PATENT DOCUMENTS

CN 101574803 A 11/2009
CN 101903134 A 12/2010
(Continued)

OTHER PUBLICATIONS

PCT/EP2017/065060, International Search Report (PCT/ISA/210) dated Sep. 5, 2017, with partial English translation (Eight (8) pages).

*Primary Examiner* — Robert F Long
*Assistant Examiner* — Xavier A Madison
(74) *Attorney, Agent, or Firm* — Crowell & Moring LLP

(57) ABSTRACT

A machine tool includes a tool holder and a pneumatic striking mechanism that includes, on a working axis, an exciter piston, a beater, and a pneumatic chamber disposed between the exciter piston and the beater. The exciter piston is drivable by the motor and includes a pot-shaped base body, a seal ring, and a tube-shaped cladding body. The pot-shaped base body has a lateral wall enclosing the working axis and a collar which protrudes in a radial direction. The tube-shaped cladding body is disposed on the pot-shaped base body surrounding the lateral wall. A groove
(Continued)

is defined between the collar and the tube-shaped cladding body and the seal ring is disposed in the groove.

11 Claims, 2 Drawing Sheets

(52) U.S. Cl.
CPC ..... *B25D 2222/27* (2013.01); *B25D 2222/54* (2013.01); *B25D 2250/345* (2013.01); *B25D 2250/365* (2013.01)

(58) Field of Classification Search
USPC ..... 173/200
See application file for complete search history.

(56) References Cited

U.S. PATENT DOCUMENTS 6,237,699 B1 * 5/2001 Plietsch ..... B25D 16/00 173/109
7,096,973 B2 * 8/2006 Ikuta ..... B25D 11/125 173/162.1
9,969,071 B2 5/2018 Nitsche et al.
2009/0277659 A1 11/2009 Roelfs et al.
2010/0300718 A1 * 12/2010 Hartmann ..... B25D 11/125 173/201
2011/0180285 A1 * 7/2011 Braun ..... B25D 16/003 173/18
2013/0277077 A1 * 10/2013 Hartmann ..... B25D 17/06 173/1
2013/0284473 A1 * 10/2013 Hartmann ..... B25D 11/125 173/1
2016/0221172 A1 * 8/2016 Geiger ..... B25D 11/125
2018/0207783 A1 * 7/2018 Liebert ..... B25D 16/00
2018/0264636 A1 * 9/2018 Geiger ..... B25D 11/125

FOREIGN PATENT DOCUMENTS

CN 104334317 A 2/2015
DE 1 133 680 B 7/1962
DE 10 2008 054 976 A1 6/2010
DE 10 2011 088 955 A1 6/2013
EP 1 584 422 A1 10/2005
EP 2 857 149 A1 4/2015
GB 2 326 368 B 6/2002

* cited by examiner

HAND-HELD MACHINE TOOL

CROSS REFERENCE TO RELATED APPLICATIONS

This application claims the priority of International Application No. PCT/EP2017/065060, filed Jun. 20, 2017, and European Patent Document No. 16176080.6, filed Jun. 24, 2016, the disclosures of which are expressly incorporated by reference herein.

BACKGROUND AND SUMMARY OF THE INVENTION

The present invention relates to a tool machine having a pneumatic striking mechanism.

EP 2 857 149 A1 describes a tool machine having a pneumatic striking mechanism and an exciter piston for the pneumatic striking mechanism. The exciter piston exhibits a circulatory groove in its lateral surface in which a seal ring is set. The elastic seal ring will be expanded during the assembly to such an extent that it can be slid forward over the lateral surface up to the groove. The elastic seal ring recontracts in the groove. The elastic seal ring must be selected with respect to the assembly.

The tool machine according to the invention has a tool holder to accommodate and lock a tool, a pneumatic striking mechanism, and a motor. An exciter piston, a beater, and a chamber that is enclosed between the exciter piston and the beater is arranged on the working axis of the pneumatic striking mechanism. The motor drives the exciter piston. The exciter piston has a pot-shaped base body, a seal ring, and a tube-shaped cladding body. The pot-shaped base body features a lateral wall that encloses the working axis, and a collar protruding in a radial direction opposite to the lateral wall. The hollow cylindrical cladding body is arranged on the base body surrounding the lateral wall, and spaced by the groove along the working axis from the collar. The seal ring is arranged in the groove.

In the tool machine according to the invention, the groove is open laterally before the cladding body's assembly. The seal ring can be slid on via the lateral wall without a widening being required. The cladding body is slid onto the lateral wall after the seal ring and locks the groove for the seal ring.

The groove preferably circulates the lateral wall in an annular manner. The groove is enclosed along the working axis in the beater's direction by the base body's collar, in a radial direction to the working axis through the base body's lateral wall and along the working axis opposite to the collar by means of an end face of the cladding body. The groove is formed by means of two separate bodies, namely the base body and the cladding body.

In its embodiment, the seal ring can abut directly on the collar and the end face, and it can be spaced from the collar only by an air gap, or it can be spaced from the end face only by an air gap.

In a preferred embodiment, the seal ring is made of a plastic having a hardness of a minimum of 85 Shore. A seal ring with a hardness starting at 85 Shore, particularly in a range between 85 Shore and 90 Shore, exhibits lower friction coefficients in the striking mechanism's metallic guide tube. Alternatively, the seal ring may consist of a brass alloy.

The embodiment provides that the base body and the cladding body consist of different materials. In particular, both bodies may be formed of different plastics, particularly thermoplastics. The base body may be selected with respect to the temperature resistance, and the cladding body with respect to a favorable friction coefficient with the guide tube. The base body will be made from a plastic in particular, which exhibits a high rigidity under increased temperatures ranging from 100° C. (Celsius) to 150° C.

One embodiment provides for the base body exhibiting a base plate, which is arranged at the beater's side from the lateral wall whereby the base plate and the collar are positioned at the same level. The seal ring can therefore be arranged as closely as possible to the pneumatic chamber in order to avoid dead volume.

One embodiment provides that an inner surface of the cladding body abuts flush on an external surface of the lateral wall. A seal element may be arranged in a radial direction between the inner surface of the cladding body and the external surface of the lateral wall. The groove is formed in an airtight manner towards the working axis.

One embodiment provides that the cladding body be sealed to the lateral wall by means of a mechanical closure. The lock may repeatedly be detachable or may be detachable only by destroying the lock. Locking may be realized by a thread, catching elements, or as the case may be.

One embodiment provides that the cladding body is glued together with or welded to the lateral wall.

One embodiment provides that the lateral wall encloses a cylindrical hollow in which a bearing for a piston rod is arranged.

The following description explains the invention with the aid of exemplary embodiments and figures.

DETAILED DESCRIPTION OF THE DRAWINGS

The same or functionally identical elements are indicated by means of the same reference number in the figures unless indicated otherwise.

Figure 1:
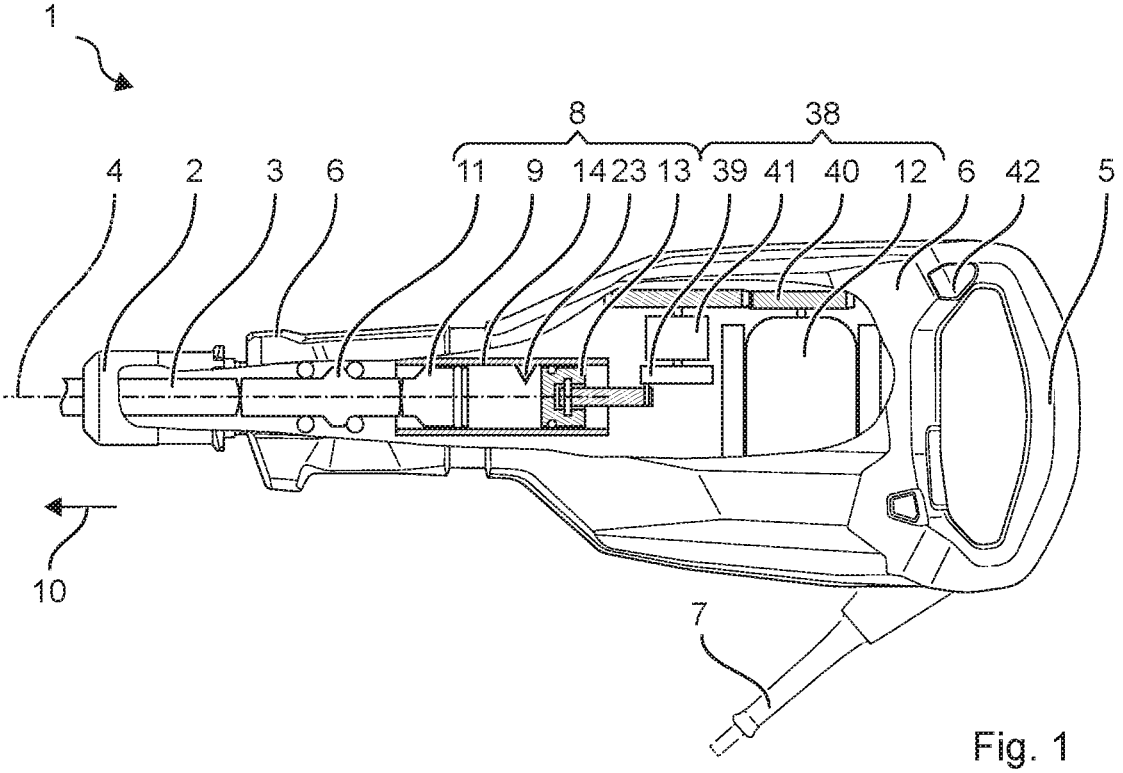
FIG. 1 illustrates a drill hammer.
Figure 2:
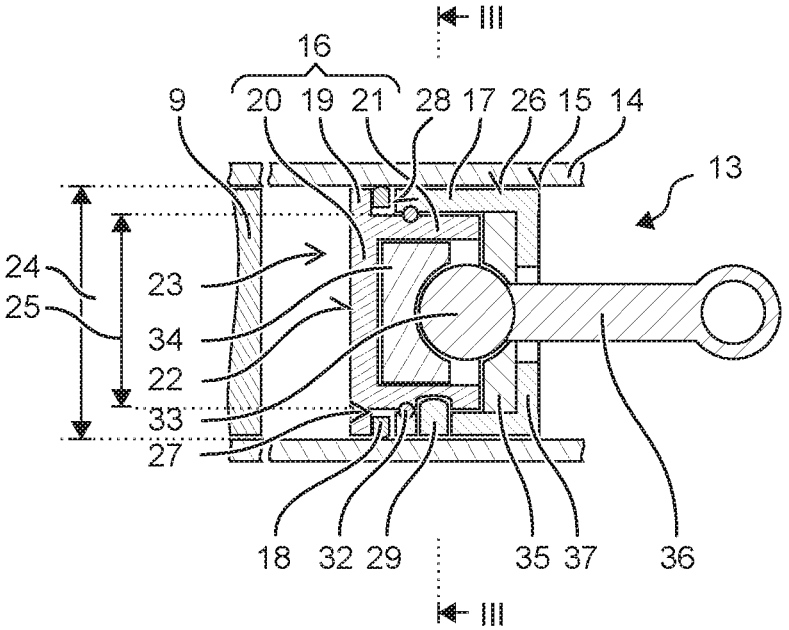
FIG. 2 is a longitudinal section of an embodiment of an exciter piston.
Figure 3:
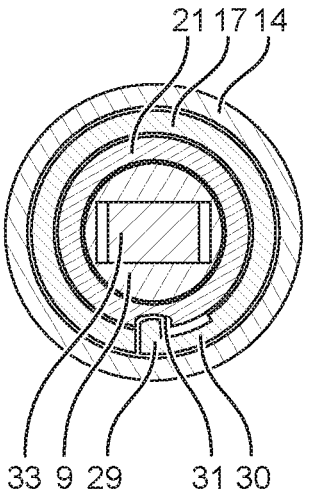
FIG. 3 is a cross section of the exciter piston through plane of FIG. 2.

FIG. 1 schematically depicts an electric hammer 1 as an example of a hand-guided chiseling tool machine. The electric hammer 1 has a tool holder 2 in which a chisel 3 or another tool is inserted along a working axis 4, which can be locked. The electric hammer 1 has a handlebar 5, which is typically attached to an end of a machine casing 6 of an electric hammer 1 that is turned away from a tool holder 2. An additional handlebar can for instance be attached near a tool holder 2. When chiseling, the operator can guide and hold the electric hammer 1 by means of the handlebars 5. An energy supply can be realized via a battery or a power cord 7.

The electric hammer 1 has a pneumatic striking mechanism 8 including a beater 9, which exercises periodic beats in the impact direction 10 onto the chisel 3 when being operated. The beater 9 is guided in a movable manner on the work axis 4. In one embodiment the beater 9 can strike the chisel 3 directly. In the illustrated embodiment, the beater 9 strikes a riveting header 11, which transfers the strike to the chisel 3 located in a tool holder 2. The riveting header 11 is arranged in the impact direction 10 from the beater 9 between the beater 9 and the tool holder 2.

The pneumatic striking mechanism 8 is driven by an electric motor 12. The electric motor 12 moves the exciter piston 13 periodically back and forth on the working axis 4. The beater 9 is coupled to the exciter piston 13 via an air spring.

The striking mechanism 8 has a guide tube 14 in which the exciter piston 13 is guided along the working axis 4. The guide tube 14 has a preferably cylindrical inner surface, which runs parallel to the working axis 4. The exciter piston 13 abuts flush on the inner surface 15. The cross-section profile of the exciter piston 13 corresponds to the hollow profile of the guide tube 14. The exciter piston 13 locks the guide tube 14 in an airtight manner opposite to the impact direction 10.

The exciter piston 13 is composed of at least the following three separate elements: a pot-shaped base body 16, a tube-shaped cladding body 17, and a seal ring 18. The pot-shaped base body 16 is introduced in the tube-shaped cladding body 17. The base body 16 has a radially protruding collar 19. The seal ring 18 encompasses the base body 16 and is arranged along the working axis 4 between the collar 19 and the cladding body 17.

The pot-shaped base body 16 has a hollow that is unilaterally opened and which is arranged on the working axis 4. The hollow is isolated along the working axis 4 in the impact direction 10 by means of a base plate 20 and in a radial direction around the working axis 4 through a lateral wall 21. The hollow is open opposite to the impact direction 10. The base plate 20 forms the end face 22 of the exciter piston 13 which closes a pneumatic chamber 23 of the striking mechanism 8.

The base plate 20 and its end face 22 essentially correspond to the hollow cross-section of the guide tube 14. In the illustrated and preferred example, the base plate 20 is circular in shape. The diameter 24 of the base plate 20 corresponds to the inner diameter of the guide tube 14. The end face 22 is preferably level.

The lateral wall 21 is arranged on a side of the base plate 20 that is turned away from the beater 9. The lateral wall 21 is preferably extensively closed around the working axis 4. The lateral wall 21 runs longitudinally or parallel to the working axis 4. The exemplary lateral wall 21 is essentially formed cylindrically.

The radial overall dimension, e.g., the external diameter 25, of the lateral wall 21 is lower than the radial overall dimension, for instance the external diameter 24, of the base plate 20. The base plate 20 is therefore radially protruding opposite to the lateral wall 21. The radially protruding ring is described here as the collar 19. The collar 19 is preferably along the working axis 4 at the same level as the base plate 20, i.e., in a radial direction in a direct extension of the base plate 20. The base plate 20 may have the same or different axial measurements in the area of the collar 19 or at the level of the working axis 4.

The pot-shape base body 16 is preferably a monolithic body. The base plate 20 and the lateral wall 21 are joined together without any joint zones and are not welded, glued, screwed together or locked in place in particular. The base body 16 preferably consists of plastic, such as a thermoplastic for instance. The plastic is preferably rigid even at temperatures ranging from 100° C. to 150° C. so that the base plate 20 will not sag when the pneumatic chamber 23 is compressed. Polyphthalamides (PPA) or irradiated polyamides are particularly suitable examples. The thermoplastic can be reinforced by means of additives. Duroplast appear to be less suitable. The base body 16 can be produced as an injection molding body.

The cladding body 17 is essentially a tube, e.g., a hollow cylinder. The cladding body 17 is set upon the lateral wall 21 of the base body 16. The lateral wall 21 centers the cladding body 17. The cladding body 17 preferably abuts in a radial direction in a positive-locking manner to the lateral wall 21. A wall thickness of the cladding body 17 essentially corresponds to the radial measurement of the collar 19. The cladding body 17 essentially has the form of an extrusion body of the collar 19 along the working axis 4. The radial inner dimension of the cladding body 17 is the same to the radial overall dimension 25 of the lateral wall 21. The exterior surface 26 of the cladding body 17 constitutes the guiding surface of the exciter piston 13. The exterior surface 26 abuts on the inner surface 15 of the guide tube 14. The external diameter 24 of the cladding body 17 is the same as the inner diameter of the guide tube 14. The exterior surface 26 is preferably cylindrical.

The cladding body 17 is spaced along the working axis 4 from the base plate 20, the collar 19. The collar 19 and the cladding body 17 conclude a ring-shaped circular groove 27 between them. The areas of the groove 27 are formed in the impact direction 10 through the collar 19 in a radial direction through the lateral wall 21 and contrary to the impact direction 10 through an end face of the cladding body 17. The groove 27 is closed along its entire circumference along the working axis 4 and in a radial direction towards the working axis 4. Air can only enter or escape the groove 27 from exterior radial. A distance of the cladding body 17 from the base plate 20, i.e., the groove's width, approximately corresponds to the axial measurement, e.g., the cord's diameter, of the seal ring 18. The seal ring 18 can abut on the collar 19 and the front surface 28 of the cladding body 17, or is only separated by means of an air gap from the collar 19 or the front surface 28.

The cladding body 17 can catch with the base body 16 to axially secure the cladding body 17 to the base body 16. The exemplary cladding body 17 has a latch 29, which can be moved in a radial direction away from the working axis 4. By way of example, the cladding body 17 is slotted as an example abutting on the latch 29. The slots form an arm 30 at the end of which latch 29 is arranged. The arm forms an elastically movable solid body pivot. The lateral wall 21 of the base body 16 is provided with a recess 31 that engages in the latch 29. The axial clearance of the latch 29 is preferably very minor and secures the cladding body 17 to the base body 16. For this, a measurement of a recess 31 along the working axis 4 may equal the measurement of the latch 29 along the working axis 4. The recess 31 may be formed by a circumferential slot, a circumferential groove, a hole, or a dome-shaped recess.

The latch 29 can be disengaged with the recess 31 by means of a radial deflection. During the deflection, the latch 29 protrudes the external surface 26. The external diameter of the cladding body 17 is greater than the inner diameter of the guide tube 14 when the latch 29 is deflected. Accordingly, the latch 29 is secured against deflections and releases when the exciter piston 13 is arranged in the guide tube 14.

In alternative embodiments, the cladding body 17 can be fastened to the base body 16 by means of screws. For instance, the inner surface of the cladding body 17 and the external surface of the lateral wall 21 can be provided with the appropriate threads. The thread can also be used as a supplement to the latch 29. In another embodiment, the cladding body 17 and the base body 16 can be glued or welded.

The cladding body 17 is preferably a monolithic body. The cladding body 17 is not composed of elements that are joined via joint zones, and particularly not of elements that are welded, glued, screwed, or are mechanically joined in some other manner. The cladding body 17 preferably consists of a plastic, for instance of a single thermoplastic. The plastic of the cladding body 17 can differ from the plastic of the base body 16. For cladding body 17, polyamides are suitable due to their high abrasion resistance and relatively simple processability. The polyamide may be mixed with Teflon (polytetrafluorethylene, PTFE), graphite or molybdenum sulfite (MoS2) to further improve the friction coefficient. The cladding body 17 can be produced as a die casting body.

The seal ring 18 is set on the lateral wall 21 of the base body 16. The seal ring 18 is closed entirely. The seal ring 18 is slid on via the lateral wall 21 until abutting on the base plate 20. Following the seal ring 18, the cladding body 17 is slid on the lateral wall 21 in the impact direction 10. The inner diameter of the seal ring 18 is preferably equal to or somewhat larger than the external diameter of the lateral wall 21, yet smaller than the diameter of the base plate 20, and smaller than the external diameter of the cladding body 17. The seal ring 18 is caught alongside the working axis 4 between the base plate 20 and the cladding body 17. The seal ring 18 preferably radially protrudes somewhat above the base plate 20 and the cladding body 17. The seal ring 18 abuts under a radial preload in an airtight manner on the inner surface 15 of the guide tube 14.

The seal ring 18 has an inner diameter, which is somewhat larger than the external diameter 25 of the lateral wall 21. A gap results between the seal ring 18 and the base body 16 in a radial direction in which the seal ring 18 can deflect. An additional seal element 32 may be arranged in a radial direction between the cladding body 17 and the lateral wall 21. The seal element 32 seals the radial inner surface of the cladding body 17 towards the radial external surface of the lateral wall 21. The seal element 32 prevents an air exchange from the groove 27 to the inner hollow of the exciter piston 13. The seal element 32 may be an O-ring as shown, or may be formed alternatively among other things by means of a press fit, by lamellas at the radial inner surface of the cladding body 17, by lamellas at the radial external surface of the lateral wall 21.

The seal ring 18 is preferably a monolithic body. The seal ring 18 consists for instance of nitrile caoutchouc, for example continuously of a single plastic. The seal ring 18 may be produced as a die casting body. The hardness of the seal ring 18 is preferably more than 85 Shore, for example more than 90 Shore, not exceeding 95 Shore. The seal ring 18 has a relatively high rigidity, which allows permanent sealing at the guide tube 14. A seal ring 18 of this type of toughness is sufficiently malleable elastically to compensate for any irregularities of the guide tube 14, but the seal ring 18 will be significantly deformed when the inner diameter of the seal ring 18 extends to the external diameter of the cladding body 17. The remaining plastic elongation after stretching exceeds 0.2%. The seal ring 18 can therefore not be slid on via the pre-mounted cladding body 17 during the assembly without being damaged. A soft seal ring 18 having a hardness ranging from 70 Shore to 80 Shore will be required for such type of assembly.

Another preferred material for the seal ring 18 is polyphthalamide. Alternatively, the seal ring 18 may also be made of a brass alloy.

A bearing for a piston rod 33 is formed within exciter piston 13. The exemplary bearing is formed by means of a first bearing shell 34 and a second bearing shell 35, which are embedded along the working axis 4 between a bolt 36. The bolt 36 is pivotable in the bearing shells 34, 35 around a pivot axis that is vertical to the working axis 4. The piston rod 33 is suspended from the bolt 36. In the embodiment shown, the bolt 36 is formed monolithically with the piston rod 33. Both bearing shells 34, 35 are located within the pot-shaped base body 16. The lateral wall 21 comprises bearing shells 35. The cladding body 17 secures both bearing shells 34, 35 by means of the covering plate 37. Alternatively, the second bearing shell 35 can be formed as part of the cladding body 17.

The beater 9 is arranged in the guide tube 14. The beater 9 is guided through the guide tube 14 along the working axis 4. The beater 9 rests in the impact direction 10 after the exciter piston 14. The beater 9 is flush to the inner surface 15 of the guide tube 14. The cross-section profile of the beater 9 corresponds to the hollow profile of the guide tube 14. The beater 9 closes the guide tube 14 in the impact direction 10.

The exciter piston 13 and the beater 9 are closing a pneumatic chamber 23 along the working axis 4. The pneumatic chamber 23 is located between the exciter piston 13 and the beater 9. The pneumatic chamber 23 forms the air spring, which couples the movement of the beater 9 to the movement of the exciter piston 13. The guide tube 14 closes the pneumatic chamber 23 in a radial direction.

The exciter piston 13 is connected via a power train 38 to the electric motor 12. The power train 38 comprises a transducer 39, which converts the rotational movement of the electric motor 12 into a translational motion. The transducer 39, which is shown as an example, is based on a cam gear driven by the electric motor 12, and a piston rod 33 that is fixed in exciter piston 13. An alternative embodiment uses a nutating disk instead of the cam gear, onto which piston rod 33 engages. Furthermore, the power train 38 may comprise a supporting gear 40 and protective mechanisms, e.g., a slip clutch 41. The mechanical and rigid connection of the exciter piston 13 to the electric motor 12 ensures a synchronous movement of the electric motor 12 and the exciter piston 13.

The electric motor 12 is fed by the power supply. The electric motor 12 can be a universal motor, a mechanically commutating electric motor 12, or an electric commutating motor 12. The operator can turn the electric motor 12 on and off by means of the operating button 42. The operating button 42 is arranged at or nearby the handlebar 5, and can be operated preferably by the hand holding the handlebar 5.

Figure 4:
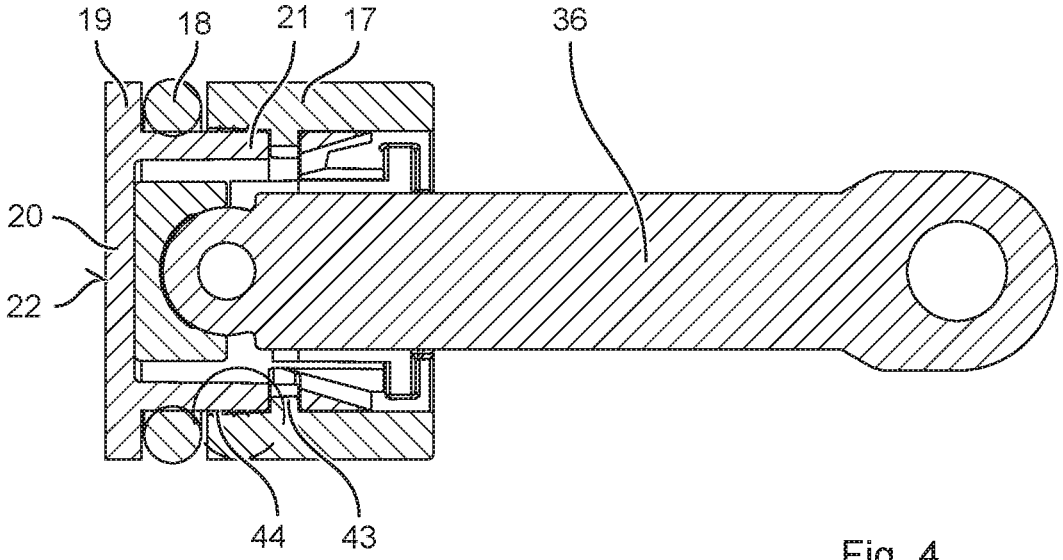
FIG. 4 is a longitudinal section of an alternative embodiment of an exciter piston.
Figure 5:
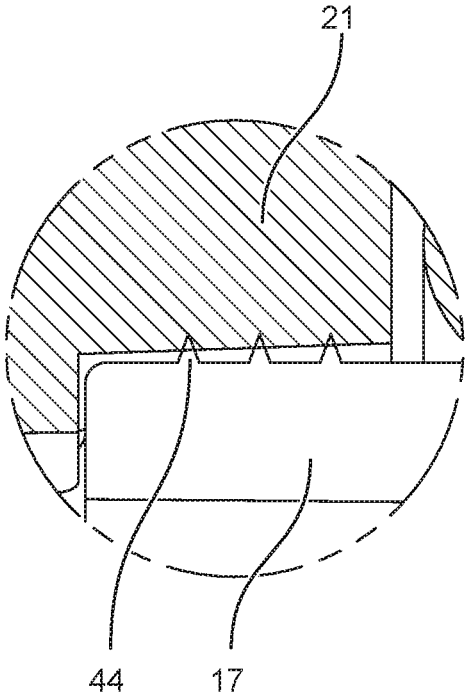
FIG. 5 is a detailed extract of FIG. 4.

FIG. 4 depicts an additional exciter piston 13. The exciter piston 13 has a base body 16, a cladding body 17, and a seal ring 18. The cladding body 17 has nibs 43 that radially protrude inwardly and which can gear into an appropriate aperture of the base body 16. The lateral wall 21 is elastic to the extent that the cladding body 17 can be slid on when bending the lateral wall 21. As soon as nibs 43 are at the aperture's level, the lateral wall 21 returns to its original form and locks in nibs 43.

The cladding body 17 is connected in a radial direction and airtight manner with the lateral wall 21 of the base body 16. The exemplary embodiment uses lamellas 44 for this purpose, which are formed at the inner surface of the cladding body 17. The lamellas 44 may be provided alternatively or additionally at the lateral wall 21.

The invention claimed is:

1. A machine tool, comprising:

a tool holder;

a pneumatic striking mechanism including, on a working axis, an exciter piston, a beater, and a pneumatic chamber disposed between the exciter piston and the beater; and a motor, wherein the exciter piston is drivable by the motor;

wherein the exciter piston includes a pot-shaped base body, a seal ring, and a tube-shaped cladding body;

wherein the pot-shaped base body has a lateral wall enclosing the working axis and a collar which protrudes in a radial direction;

wherein the tube-shaped cladding body is disposed on the pot-shaped base body surrounding the lateral wall;

wherein a groove is defined between the collar and the tube-shaped cladding body;

wherein the seal ring is disposed in the groove;

wherein the pot-shaped base body has a base plate which is disposed from the lateral wall at a beater side of the lateral wall.

2. The machine tool according to claim 1, wherein the groove is defined by the collar in an impact direction, by the lateral wall in the radial direction, and by a front surface of the tube-shaped cladding body in a direction opposite to the impact direction.

3. The machine tool according to claim 2, wherein the seal ring abuts directly on the collar and the front surface or wherein the seal ring is separated by an air gap from the collar and the front surface.

4. The machine tool according to claim 1, wherein the seal ring is comprised of a plastic having a hardness of a minimum of 85 Shore or of a brass alloy.

5. The machine tool according to claim 1, wherein the tube-shaped cladding body is lockable via a mechanical lock to the lateral wall.

6. The machine tool according to claim 1, wherein the tube-shaped cladding body is glued to, or welded onto, the lateral wall.

7. The machine tool according to claim 1, wherein the lateral wall defines a cylindrical hollow in which a bearing is disposed for a piston rod.

8. The machine tool according to claim 1, wherein the base plate and the collar lie in one plane.

9. A machine tool, comprising:

a tool holder;

a pneumatic striking mechanism including, on a working axis, an exciter piston, a beater, and a pneumatic chamber disposed between the exciter piston and the beater; and a motor, wherein the exciter piston is drivable by the motor;

wherein the exciter piston includes a pot-shaped base body, a seal ring, and a tube-shaped cladding body;

wherein the pot-shaped base body has a lateral wall enclosing the working axis and a collar which protrudes in a radial direction;

wherein the tube-shaped cladding body is disposed on the pot-shaped base body surrounding the lateral wall;

wherein a groove is defined between the collar and the tube-shaped cladding body;

wherein the seal ring is disposed in the groove;

wherein the pot-shaped base body and the tube-shaped cladding body are comprised of different materials.

10. A machine tool, comprising:

a tool holder;

a pneumatic striking mechanism including, on a working axis, an exciter piston, a beater, and a pneumatic chamber disposed between the exciter piston and the beater; and a motor, wherein the exciter piston is drivable by the motor;

wherein the exciter piston includes a pot-shaped base body, a seal ring, and a tube-shaped cladding body;

wherein the pot-shaped base body has a lateral wall enclosing the working axis and a collar which protrudes in a radial direction;

wherein the tube-shaped cladding body is disposed on the pot-shaped base body surrounding the lateral wall;

wherein a groove is defined between the collar and the tube-shaped cladding body;

wherein the seal ring is disposed in the groove;

wherein an inner surface of the tube-shaped cladding body abuts flush on an external surface of the lateral wall.

11. The machine tool according to claim 10, wherein a seal element is disposed in the radial direction between the inner surface of the tube-shaped cladding body and the external surface of the lateral wall.

* * * * *